United States Patent [19]

Prebensen

[11] 4,226,559

[45] Oct. 7, 1980

[54] ROCK BOLTING APPARATUS

[75] Inventor: Sören P. Prebensen, Nacka, Sweden

[73] Assignee: Atlas Copco Aktiebolag, Nacka, Sweden

[21] Appl. No.: 938,357

[22] Filed: Aug. 31, 1978

[30] Foreign Application Priority Data

Aug. 31, 1977 [SE] Sweden ..... 7709760

[51] Int. Cl.[3] ..... E21D 20/00

[52] U.S. Cl. ..... 405/303; 29/809; 173/22; 405/259

[58] Field of Search ..... 405/259, 260, 261, 303; 173/22, 38, 42; 175/52; 29/810, 813, 812, 809

[56] References Cited

U.S. PATENT DOCUMENTS

| | | | |
|---|---|---|---|
| 2,771,273 | 11/1956 | Pond | 405/259 X |
| 3,210,834 | 10/1965 | Orr et al. | 29/810 X |
| 3,218,893 | 11/1965 | Madison et al. | 173/22 X |
| 3,246,705 | 4/1966 | Chappuis | 173/44 |
| 3,622,039 | 11/1971 | Lindstrom | 29/809 X |
| 3,670,387 | 6/1972 | Nagao | 29/809 X |
| 3,772,757 | 11/1973 | Goldstein | 29/810 X |

FOREIGN PATENT DOCUMENTS

| | | |
|---|---|---|
| 1198309 | 8/1965 | Fed. Rep. of Germany . |
| 1217318 | 5/1966 | Fed. Rep. of Germany . |

*Primary Examiner*—Dennis L. Taylor

*Attorney, Agent, or Firm*—Frishauf, Holtz, Goodman & Woodward

[57] ABSTRACT

A rock bolting apparatus comprises a rock drill, a bolt setting apparatus, and a magazine for rock bolts. Plates for the bolts are stapled in a magazine separated from the bolts. The plate magazine is located at the front end of the bolt magazine. The plates are used to centralize the bolts relative to the borehole.

12 Claims, 8 Drawing Figures

1
2
11
12
13
14
15
16
17
18
19
20
21
22
23
24
25
26
27
28
29
30
31
32
33
34
35
37
38
39
40
41
46
47
48
55
59
60
69
70

24
38
59
61
52
60
62
43
5
5
39
41
46
22
44
51
50
49
40
42
7
7
31

ROCK BOLTING APPARATUS

BACKGROUND OF THE INVENTION

This invention relates to a rock bolting apparatus comprising a rock drill and a bolt setting machine, both of which are mounted to be laterally power displaceable to and from their position for operation and are axially power feedable, and further comprising a magazine for rock bolts, the bolts being power displaceable to an operating position in alignment with a borehole made by the rock drill.

It is an object of the invention to provide a compact and robust apparatus of the kind referred to above. To this end there is provided a magazine for storing the plates for the bolts separately from the bolts. The magazine for the plates is located at the front end of the magazine for the bolts. A further advantage of this conception is that the apparatus can be easily adapted to plates of any desired size.

DETAILED DESCRIPTION

Figures 1, 2, 3:
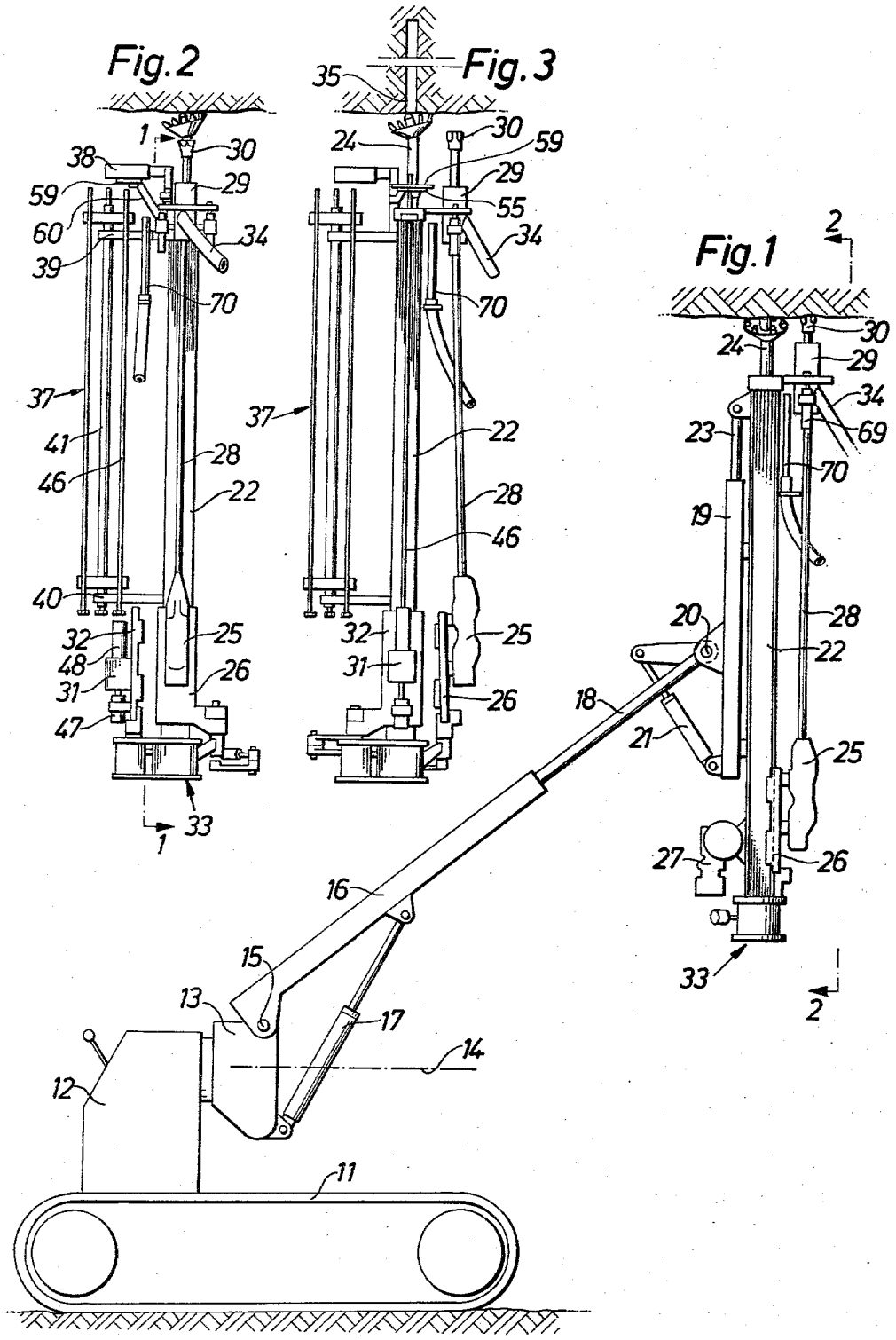
FIG. 1 is an elevational view of a rock bolting device mounted at the outer end of a boom that is mounted on a crawler borne chassis, the figure being taken along line 1—1 in FIG. 2 and some elements shown in FIG. 2 being cut away.
FIG. 2 is a view along line 2—2 in FIG. 1.
FIG. 3 is a view corresponding to FIG. 2 but showing alternative positions of various elements.

In FIG. 1, a self propelled crawler wagon 11 is shown. It has an upstanding frame portion 12 on which a holder 13 is mounted to be power turnable about a horizontal axis 14. By means of a pivot 15, the holder 13 carries the inner end of a boom 16 that is swingable by means of an hydraulic cylinder 17. The boom 16 is telescopically extendible and its outer portion 18 carries a feed beam holder 19 that can be swung about a pivot 20—that is parallel with the pivot 15—by means of a hydraulic cylinder 21. The feed beam holder 19 carries a feed beam 22 that is axially displaceable relative to the holder 19 by means of an hydraulic cylinder that is located in the holder 19. The piston rod of this hydraulic cylinder is designated 23.

Figure 4:
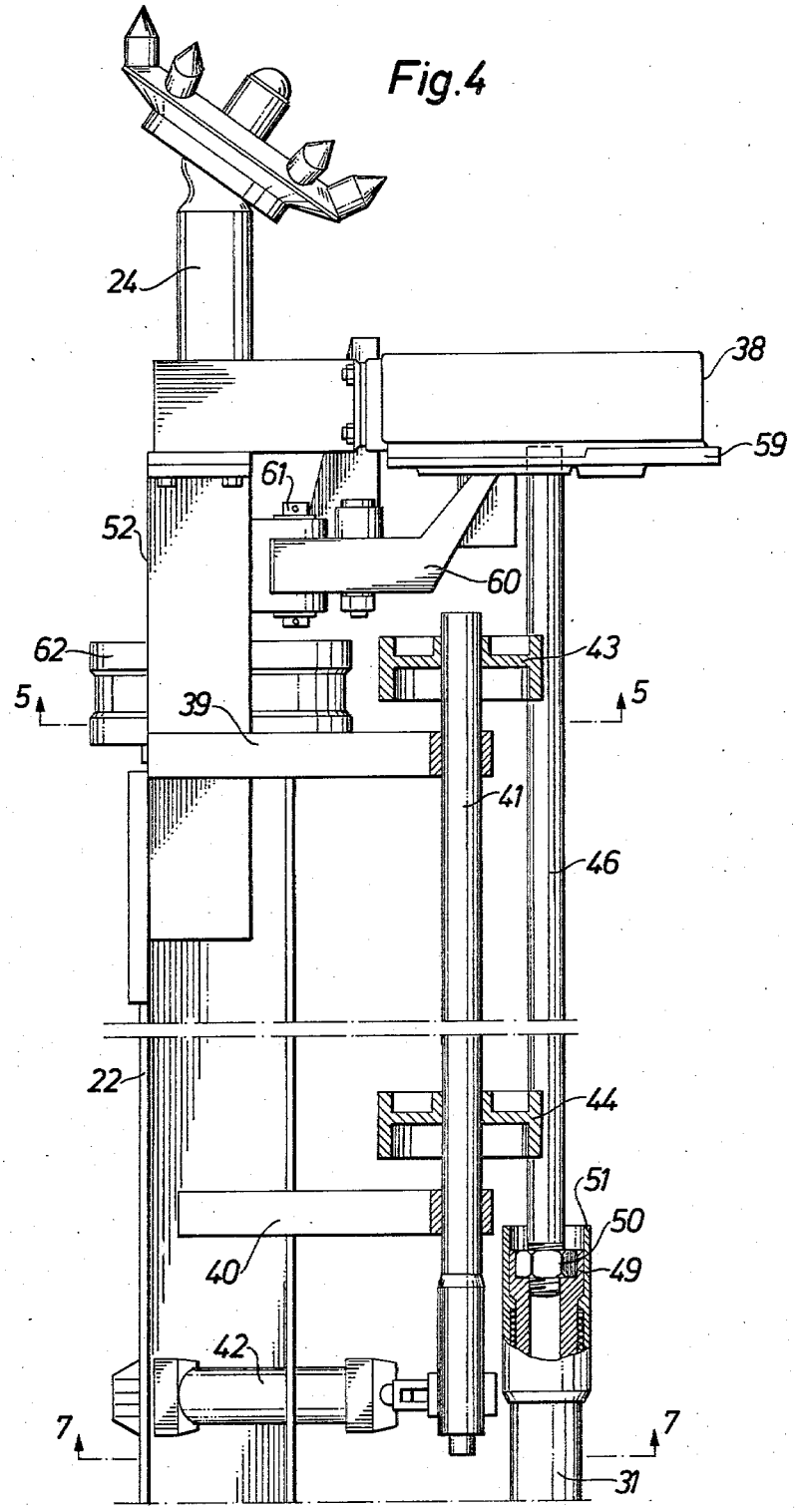
FIG. 4 is an enlarged fragmentary elevational view seen as FIG. 1 and showing a part of the elements that are cut away in FIG. 1.

The feed beam 22 has a support 24 that is hydraulically extensible against the rock face. A percussive rock drill 25 mounted on a slide (cradle) 26 is in FIG. 1 shown on the feed beam. The rock drill is coupled to a drill rod 28 that is guided by a centralizer 29 on the front portion of the feed beam 22. The centralizer 29 is combined with a suction hood for collecting drill dust and the suction hood can be connected to a suction hose 34. The drill rod 28 has a drill bit 30. A feed motor has been designated 27. In order to make FIG. 1 more clear, a bolt setting machine 31 mounted on a slide (cradle) 32, a magazine 37 for rock bolts, and a magazine 38 for plates for the rock bolts have been cut away. However, they are shown in FIGS. 2,3, and 4. In FIG. 2, the rock drill 25 is shown in its operative position with its slide 26 sliding on the feed beam 22, whereas the bolt setting machine 31 and its slide 32 is shown swung away from its operative position. In FIG. 3, the rock drill 25 with its slide 26 is shown swung away, whereas the bolt setting machine 31 with its slide 32 is shown swung into working position on the feed beam 22. The swinging of the two slides 31 and 32 is carried out by means of motors and mechanisms 33 that are not closely shown nor described, but which are described in more detail in the U.S.A. patent application Ser. No. 882,236. When a slide 26 and 32, respectively, is swung into its working position on the feed beam 22, it will engage with a non-illustrated feed chain that is coupled to the feed motor 27. When the slide 26 or 32 on the feed beam is fed forwardly from its rear end position it will automatically disconnect from the swing mechanism 33, and when it is returned to its rear end position it will again be automatically coupled to the swing mechanism 33 so that the slides 26 and 32 can be exchanged in this position. The bolt setting machine 31 comprises a pressure fluid operated rotation motor, preferably a hydraulic motor.

Figure 7:
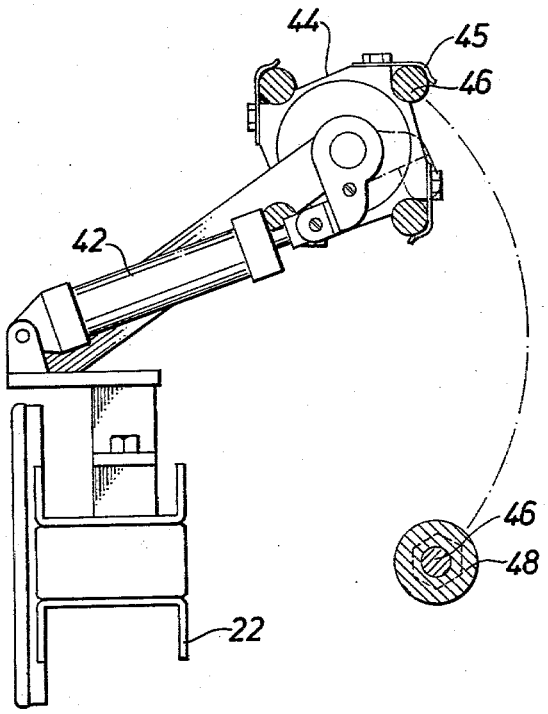
FIG. 7 is a section taken along line 7—7 in FIG. 4.

Two brackets 39, 40 on the feed beam 22 carries the magazine 37 for bolts. The magazine has a rotatable shaft 41 that can be indexed in 45° steps by means of an hydraulic indexing cylinder 42 (FIG. 4). An upper and a lower holding plate 43, 44 are affixed on the shaft 41, and they have four snap springs 45 each (FIG. 7) by means of which four rock bolts can be held in the magazine. One rock bolt has been designated 46. The bolt setting machine 31 is axially displacably mounted on its slide 32 so that it can be axially displaced by means of a hydraulic cylinder 47 (FIG. 2), and the bolt setting machine 31 has an elongated drive portion 48 with a hexagonal socket 49 for receiving nuts 50 that are threaded onto the rear end of the bolts. Around the hexagonal socket 49 there is a nut catching sleeve 51 that is spring biased into its forwardmost position shown in FIG. 4, but which will be forced backwardly when it abuts a plate during the insertion of a bolt. In FIG. 2, the bolt setting machine 31 is shown in its outswung position in which it is coaxial with the bolt 46 in the magazine 37 for bolts. In FIG. 4, the bolt setting machine 31 is shown in the same position as in FIG. 2, except that it is axially displaced forwardly on its slide 32 by means of the cylinder 47 so that its sleeve 51 has caught the nut 50 on the bolt 46. In FIG. 7, the drive portion 48 of the bolt setting machine 31 is shown when the bolt setting machine is swung into its operative position on the feed beam and has taken the bolt 46 with it. The bolt 46 is in FIG. 7 shown by dashed lines in its position in the magazine. In FIG. 3, the bolt setting machine 31 is shown in its operative position, that is, in its position for driving the bolt 46 into a borehole 35 that has just been made by the rock drill 25.

Figure 8:
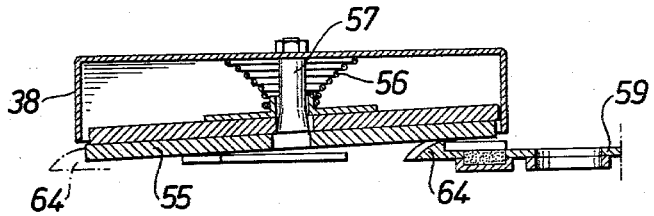
FIG. 8 is a fragmentary section taken along line 8—8 in FIG. 5.

The magazine 38 for plates is mounted on a bracket 52 that is affixed to the feed beam 22. It has two inwardly folded lugs 53, 54 against which the outermost plate 55 rests. In FIG. 8, two plates are shown in the magazine. The pile of plates in the magazine is biased against the lugs 53, 54 by a spring 56 that surrounds a fixed central dowel 57. The dowel 57 extends through all the plates except the outermost one, and it has a bevelled end face. The magazine 37 for bolts has one of its positions for bolts coaxial with the dowel 57 of the magazine for plates and with the holes of the plates.

A plate fetcher 59 is mounted on an arm 60 that is pivotally attached to the bracket 52 by means of a pivot 61 that is parallel with the feed beam 22. Between the arm 60 and a turnable unit 62, a link 63 is pivotably connected in order to swing the plate fetcher 59 between its fetching position in FIG. 3 and the bolt setting position in FIG. 6. In order to make FIG. 5 more clear, the magazine 37 for bolts is not shown in this figure. The plate fetcher 59 has a hook-like edge 64 that is bevelled so that it will force the outermost plate 55 inwardly against the action of the spring 56 when it passes the plate. The plate 55 will then snap down behind the edge 64 so that the edge grips the plate as is shown by dashed lines in FIG. 8. The plate fetcher 59 has two permanent magnets 65, 66 of different size and force by which it holds the plate 55 when it moves the plate to the position of FIG. 6 for the insertion of the bolt. The plate fetcher 59 has a hole 67 coaxial with the plate.

Figure 5:
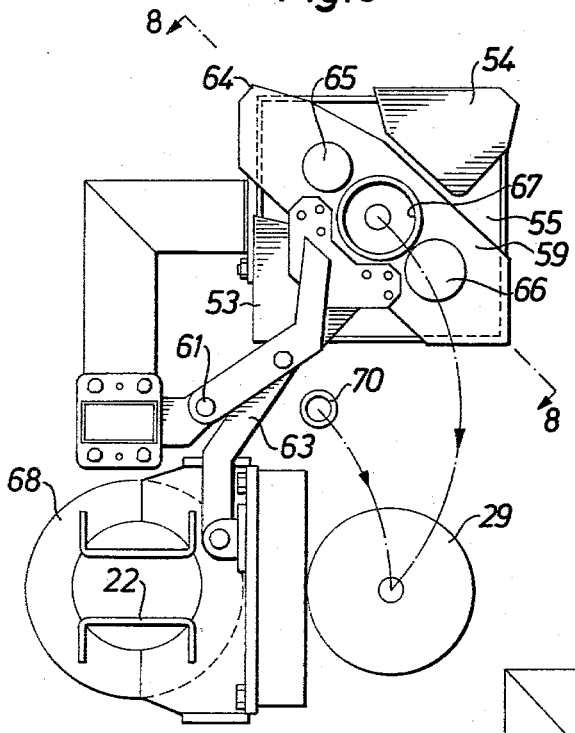
FIG. 5 is a cross section taken along line 5—5 in FIG. 4.
Figure 6:
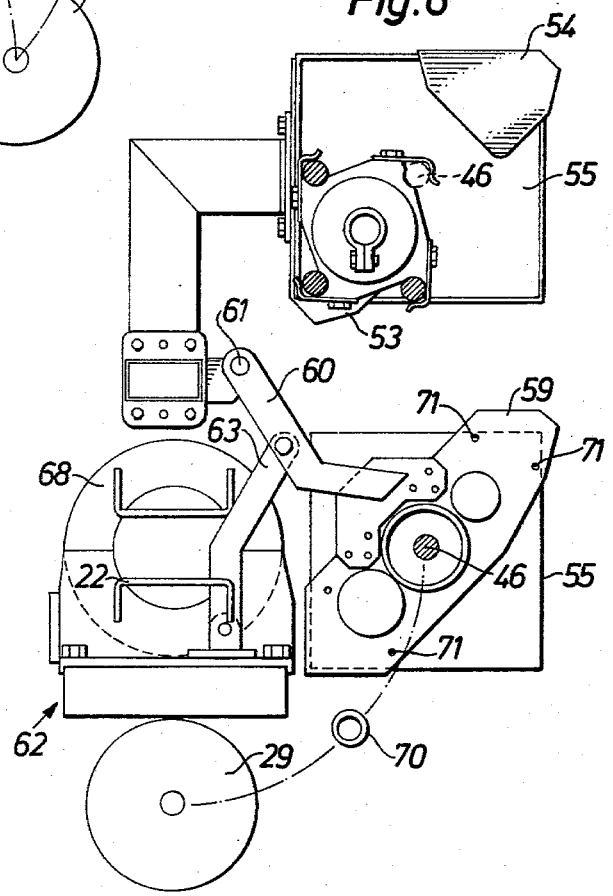
FIG. 6 corresponds to FIG. 5 but shows other relative positions of some details.

The turnable unit 62 is turned by a built-in annular hydraulic turn motor 68 of the kind having two vanes. Such motors are well known in the art and therefore, the motor 68 is neither shown nor described in detail. The unit 62 carries the centralizer 29 and a loading pipe 70 for resin cartridges. The centralizer 29 is axially displaceable by means of two compressed air cylinders 69 and the loading pipe 70 is axially displaceable by means of a non-illustrated compressed air cylinder. Conveniently, the loading pipe 70 is connected to a flexible hose that extends along the boom 16 so that the operator can carry out the loading from his usual place. The turn motor 68 is associated with a mechanical indexing device (non-illustrated) that gives the unit three fixed turn positions at 45° relative to each other, namely (1) the centralizer 29 in its working position as shown in FIGS. 1 and 5 in which position the plate fetcher 59 is in position for fetching a plate from the magazine 38 of plates, (2) a non-illustrated intermediate position in which the loading pipe 70 is coaxial with a borehole made by the rock drill, and (3) the plate fetcher 59 is in position for centralizing a plate with the borehole that has been loaded with resin cartridges. This latter position is shown in FIG. 6.

The motor 68 of the turn unit 62 is arranged to turn the turn unit 62 conjointly with the swinging movements of the rock drill 25 and the bolt setting machine 31.

A complete bolt setting operation will now be described. At first, the feed beam 22 is positioned adjacent the rock face and the support 24 is extended to take support against the rock face with a suitable predetermined force, as shown in FIG. 2. Then, the feed beam 22 is axially displaced forwardly by means of the cylinder 23 against the action of the support 24 so that the support 24 is forced inwardly until the drill bit 30 is in contact with the rock face as shown in FIG. 1. The support 24 consists of a circular plate on a piston rod to a hydraulic cylinder that is mounted in the feed beam 22 and the support can therefore be maintained under constant hydraulic load outwardly so that it will not loose engagement with the rock face when the feed beam 22 is displaced forwardly and rearwardly in its holder 19. The centralizer 29 is now displaced forwardly into contact with the rock face by means of the hydraulic cylinder 69 and the drilling can be carried out.

When the drilling is completed the rock drill 25 and the drill centralizer 29 are retracted to their positions in FIG. 1, and the feed beam 22 is retracted to its position shown in FIGS. 2 and 3 with the support 22 still forced against the rock face.

The turning unit 62 is now turned 45° so that the centralizer 29 is swung out of alignment with the borehole and the loading pipe 70 is instead swung into alignment with the borehole. The loading pipe 70 is now fed forwardly towards the borehole and some centimeters into the borehole. Cartridges containing a two-component resin with sand as a filler is blown into the borehole through the loading pipe 70, and the loading pipe 70 is again retracted to its position shown in FIGS. 2 and 3.

During the turning movement of the turning unit 62, the plate fetcher 59 is also moving because of the link 63 and it takes a plate 55 out of the magazine 38. The plate 55 takes a bolt 46 with it, which bolt was inserted through the hole of the plate 55 to abut against the dowel 57 of the magazine 38 when the bolt setting machine 31 was fed forwardly on its slide 32 by means of the cylinder 47 into engagement with the nut of the bolt when the bolt setting machine was in its position shown in FIG. 2. The slide 32 of the bolt setting machine 31 is swung in synchronism with the turning device 62 when the latter is turned into position for loading, simultaneously with the slide 26 of the rock drill 25 being swung away from the feed beam 22.

When the loading is completed, the turning unit 62 is turned to its position shown in FIG. 6 in which the plate fetcher 59 holds the plate 55 in alignment with the borehole 71. Simultaneously, the slide 26 of the rock drill 25 is swung out to its position shown in FIG. 3 and the slide 32 of the bolt setting machine 31 is swung into its position on the feed beam 22 as shown in FIG. 3. The bolt setting machine is now displaced forwardly on its slide 32 by means of the cylinder 46 a distance equal to the distance the feed beam 22 was retracted when drilling was completed. Then, the slide 32 of the bolt setting machine 31 is fed forwardly along the feed beam while the bolt setting machine 31 rotates the bolt so that the bolt destroys the cartridges in the borehole and mixes the contents of the cartridges. The plate 55 functions as a bolt centralizer, i.e. it holds the bolt aligned with the borehole while the bolt is driven towards and into the borehole. During the last part of the insertion of the bolt 46 in the borehole, the guide portion 48 of the bolt setting machine protrudes into the hole 67 in the plate fetcher 59 and presses the plate 55 away from the magnets 65,66 of the plate fetcher so that the plate goes with the bolt up into engagement with the rock face.

When the slide 32 of the bolt setting machine 31 has been moved to its rearmost position on the feed beam 22 and the bolt setting machine 31 has been moved to its rearmost position on its slide 32 the slide 32 can be swung out to its bolt fetching position shown in FIG. 2 and the slide 26 of the drill 25 can be swung into position on the feed beam 22. Simultaneously the turning unit 62 turns back to its position in FIGS. 2 and 5. The indexing device 42 has turned the magazine 37 for bolts one step during the retraction of the slide 32 of the bolt setting machine 31 so that another bolt is coaxial with the dowel 57 in the magazine 38 for plates. The support 24 of the feed beam 22 can be retracted and the entire rock bolting device can be positioned for another bolt setting operation by means of the boom 16, 18.

Conveniently, control systems, for instance control systems of the sequential type, is used to control the drilling sequence, the loading sequence and the bolt setting sequence automatically so that the operator only starts each sequence.

In the operation as described above, the nut threaded onto each bolt is not used for final tightening since the nut will be threaded all the way to the end of the threads of the bolt already when the bolt setting machine starts to rotate the nut. If a final tightening is desirable, the rear end of the threads of the bolt can be sealed, for instance by being deformed, so that the nut can not be screwed off the bolt. In this case the bolt can be rotated in left hand rotation when forced into the borehole. This means that a nut will be rotated to its rear end position on the threads of the bolt and a final tightening by turning the nut in right hand turn is possible.

If plates of a smaller size than the plates shown is wanted, the apparatus can easily be adapted to these plates. The magazine 38 for the plates can be exchanged and additional plate holding hooks of the same kind as the fixed hooks 64 can be screwed to the plate fetcher 59. To this end the plate fetcher can be provided with predrilled and threaded holes 71 as shown in FIG. 6.

What I claim is:

1. Rock bolting apparatus comprising:

a rock drill (25) and a bolt setting machine (31), both of which are mounted to be laterally power displaceable to an from their position for operation and are axially power feedable;

a magazine (37) for rock bolts, the rock bolts (46) being power displaceable to an operating position in alignment with a borehole made by the rock drill;

a magazine (38) for plates in which the plates (55) are stored separated from the rock bolts (46), said plates having a rock bolt receiving opening therein and said plate magazine (38) being located at the front end of the bolt magazine (37); and a centralizer for centralizing a rock bolt (46) during insertion of a rock bolt in the borehole, the centralizer comprising a holder (59) for a plate (55) that is to be used with the rock bolt, and means (60,62,63) for locating said holder (59) relative to the borehole such that the opening of said plate is aligned with said borehole so that the plate with its bolt receiving opening will centralize the rock bolt.

2. Rock bolting apparatus according to claim 1 wherein said locating means includes a device (59,60,63) for moving a plate from the plate magazine (38) to a position in alignment with the borehole.

3. Rock bolting apparatus according to claim 2 wherein the bolt setting machine (31) is mounted to be laterally swingable between a bolt catching position and a working position, and the plate moving device (59,60,63) is arranged to move the plate (55) in a bow-formed path.

4. Rock bolting apparatus according to claim 1 wherein the bolt setting machine (31) is laterally displaceable into a position coaxial with a bolt (46) in the bolt magazine (37) and axially displaceable in this lateral position in order to engage with the bolt.

5. Rock bolting apparatus according to claim 1 wherein the bolt setting machine (31) is arranged to fetch the bolts from the bolt magazine (37) and is power displaceable laterally between a position for catching a bolt in the magazine and a working position for driving the bolt into the borehole.

6. Rock drilling apparatus according to claim 5 wherein in its position for catching a bolt, the bolt setting machine (31) is arranged to displace the bolt (46) forwardly into engagement with a plate (55) in the plate magazine (38).

7. Rock drilling apparatus according to claim 6 wherein said locating means includes a plate moving device (59,60,63) arranged to move a plate which is in engagement with the bolt to a position in alignment with the borehole.

8. Rock bolting apparatus according to claim 1 wherein the bolt magazine (37) is a revolving magazine and the plate magazine (38) is coaxial with one of the bolt positions of the bolt magazine.

9. Rock bolting apparatus according to claim 1 comprising a common elongated guideway for the rock drill and the bolt setting machine; and means for alternatively moving the rock drill and the bolt setting machine into position on the common guideway.

10. Rock bolting apparatus comprising:

a rock drill (25) and a bolt setting machine (31), both of which are mounted to be laterally power displaceable to an from their postion for operation and are axially power feedable;

a magazine (37) for rock bolts, the rock bolts (46) being power displaceable to an operating position in alignment with a borehole made by the rock drill;

a magazine (38) for plates in which the plates (55) are stored separated from the rock bolts (46), said plates having a rock bolt receiving opening therein and said plate magazine (38) being located at the front end of the bolt magazine (37); and said bolt setting machine (31) being arranged to fetch the rock bolts from the bolt magazine (37) being powder displaceable laterally between a position for catching a rock bolt in the bolt magazine (37) and a working position for driving a rock bolt into the borehole, said bolt setting machine, in its position for catching a rock bolt (46), being arranged to displace the rock bolt (46) forwardly into engagement with a plate (55) in the plate magazine (38); and a plate moving device (59,60,63) arranged to move a plate, which is in engagement with a rock bolt, from the plate magazine (38) to a position in alignment with the borehole such that the rock bolt engaged with the moved plate is in alignment with the borehole.

11. Rock bolting apparatus according to claim 10 wherein the bolt magazine (37) is a revolving magazine and the plate magazine (38) is coaxial with one of the bolt positions of the bolt magazine.

12. Rock bolting apparatus according to claim 10 comprising a common elongated guideway for the rock drill and the bolt setting machine; and means for alternatively moving the rock drill and the bolt setting machine into position on the common guideway.

* * * * *

UNITED STATES PATENT AND TRADEMARK OFFICE

CERTIFICATE OF CORRECTION

PATENT NO. : 4,226,559

DATED : October 7, 1980

INVENTOR(S) : Soren P. PREBENSEN

It is certified that error appears in the above-identified patent and that said Letters Patent are hereby corrected as shown below:

COLUMN 6, line 27 (claim 10), change "postion" to --position--; change "to an from" to --to and from--.

COLUMN 6, line 40 (claim 10), before "displaceable" change "powder" to -- power --.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*